US006390337B1

(12) United States Patent
Shea

(10) Patent No.: US 6,390,337 B1
(45) Date of Patent: May 21, 2002

(54) GRAVITY FEED DISPENSING DEVICE

(76) Inventor: Thomas M. Shea, 1343 Rochester Rd., Suite 100, Troy, MI (US) 48083

( * ) Notice: Subject to any disclaimer, the term of this patent is extended or adjusted under 35 U.S.C. 154(b) by 0 days.

(21) Appl. No.: 09/697,219

(22) Filed: Oct. 26, 2000

Related U.S. Application Data

(63) Continuation-in-part of application No. 29/130,127, filed on Sep. 27, 2000.

(51) Int. Cl.[7] ..... B67D 3/00

(52) U.S. Cl. ..... 222/181.2; 221/92; 221/281; 221/283; 221/303; 221/305

(58) Field of Search ..... 222/181.2; 221/92, 221/281, 283, 303, 305

(56) References Cited

U.S. PATENT DOCUMENTS

| | | | | | |
|---|---|---|---|---|---|
| 617,284 | A | * | 1/1899 | Darnes | 221/283 |
| 713,151 | A | * | 11/1902 | Randle | 221/281 |
| 1,613,529 | A | * | 1/1927 | Payne | 221/92 |
| 2,822,954 | A | * | 2/1958 | Taylor | 221/283 |
| 3,194,433 | A | * | 7/1965 | Heselov | 221/92 |
| 3,265,246 | A | * | 8/1966 | Messenger | 221/283 |
| 4,562,941 | A | | 1/1986 | Sanfilippo | |
| 4,732,282 | A | | 3/1988 | Lockwood | |
| 4,794,764 | A | | 1/1989 | Dyment et al. | 62/250 |
| 4,846,775 | A | | 7/1989 | Herrin | |
| 4,858,756 | A | | 8/1989 | Herrin et al. | |
| 5,037,005 | A | | 8/1991 | Appleby et al. | |
| 5,069,334 | A | | 12/1991 | Herrin et al. | |
| 5,117,972 | A | | 6/1992 | Herrin et al. | |
| 5,139,173 | A | | 8/1992 | Evinger | |
| 5,143,252 | A | * | 9/1992 | Shi | 221/303 |
| 5,191,997 | A | | 3/1993 | Squitieri | 221/119 |
| 5,361,937 | A | * | 11/1994 | Wiese | 221/281 |
| 5,385,272 | A | | 1/1995 | Aoun | |
| 5,458,233 | A | | 10/1995 | Herrin | |
| 5,458,260 | A | | 10/1995 | Sainato et al. | 221/22 |
| 5,499,484 | A | | 3/1996 | Herrin | |
| 5,553,723 | A | | 9/1996 | Stein | |
| 5,599,267 | A | | 2/1997 | Dupuy | |
| 5,673,823 | A | | 10/1997 | Hanks et al. | |
| 5,678,492 | A | | 10/1997 | Pinkstone et al. | |
| 5,746,328 | A | | 5/1998 | Beeler et al. | |
| 5,806,689 | A | | 9/1998 | Mays et al. | |
| D400,761 | S | | 11/1998 | Rushing | |
| D401,476 | S | | 11/1998 | Henry et al. | |
| D402,160 | S | | 12/1998 | Rushing | |
| D404,600 | S | | 1/1999 | Henry et al. | |
| 6,004,251 | A | | 12/1999 | Herrin | |
| D418,331 | S | | 1/2000 | Christescu | |
| D421,550 | S | | 3/2000 | Henry et al. | |

* cited by examiner

*Primary Examiner*—J. Casimer Jacyna
(74) *Attorney, Agent, or Firm*—Gifford, Krass, Groh, Sprinkle, Anderson & Citkowski, P.C.

(57) ABSTRACT

A gravity teed device for holding and dispensing quantities of merchandise and which is capable of being supported upon an upright merchandising display. An elongated and substantially sleeve shaped blank has first, second, third and fourth interconnecting and elongate extending sides, a open top, and a bottom. An opening is defined in the first side, proximate the bottom, and forms a vertical abutment extending between a lower-most edge of the opening and the bottom and acts to prevent unassisted dispensing of quantities of merchandise. A support member extends proximate the open top and from which the device is supported at a specified elevated location and upon the merchandising display. A first end of the member secures to a selected location along the upright merchandising display, a second end of the support member engaging the top of the display.

14 Claims, 5 Drawing Sheets

GRAVITY FEED DISPENSING DEVICE

CROSS REFERENCE TO RELATED APPLICATIONS

The present application is a continuation-in-part of U.S. Design Application Ser. No. 29/130,127, filed Sep. 27, 2000, for a Gravity Feed Dispenser.

BACKGROUND OF THE INVENTION

1. Field of the Invention

The present invention relates generally to feed dispensing devices for holding, and dispensing quantities of smaller sized merchandise. More particularly, the present invention is directed to a display supported and gravity fed dispenser which provides the combined features of significant holding capacity for quantities of merchandise, ease of product loading, high product visibility and convenience in mounting to existing upright merchandise shelves and gondola displays.

2. Description of the Prior Art

The prior art is well documented with various types of product dispensing apparatuses, the purpose for which invariably being the ability to hold a sizable volume of loose or bulk products for selective displacement in a retail store setting. The advantage of such product dispensing apparatuses is that they further supplement the product carrying capabilities of traditional store shelving displays.

A first example of such a bulk product dispenser is illustrated in U.S. Pat. No. 5,139,173, issued to Evinger, and which discloses a plasticized container with an angularly related lower wall (or ramp) which directs product toward a downwardly directed opening in the container. A combined product ramp and chute spring, within the container is biased upwardly to a product blocking position. When manually depressed, the chute flexes the ramp upwardly above a product stop, permitting product to flow over the stop and into the chute. A chute safety lever prevents inadvertent product dispensing and is designed to be operated by the same user's hand that pushes the chute downwardly.

A further example of a bottom-feeding container is illustrated in U.S. Pat. No. 5,673,823, issued to Hanks, and which includes a housing member having a top panel, a bottom panel, a front panel, a back panel, and two opposing side panels. A generally cylindrical shaped and downwardly angled dispensing portion extends through a lower front of the housing and facilitates the feeding of a dry or fluid substance through the opening.

U.S. Pat. No. 5,458,233, issued to Herrin, teaches a display container constructed of a foldable and plastic/transparent blank with a sealed top and bottom and so that a desired product may be displayed in visible fashion through the transparent plastic display container. Unlike Evinger, the disclosure of Herrin seeks to provide a theft proof way to view samples of products outside of their packaging, and is therefore not particularly relevant to product dispensing apparatuses.

SUMMARY OF THE PRESENT INVENTION

The present invention is a gravity feed device suitable for holding and dispensing large quantities of merchandise, such as boxes, bottles and loose or bulk products. The dispensing device is further capable of being supported upon an upright merchandising display and includes an elongated and substantially sleeve shape with first, second, third and fourth interconnecting sides, and open top and a bottom. In the preferred variant, the device is provide as an assembleable blank with a foldable bottom flap and which is substantially transparent.

Selective product dispensing is provided by an opening, preferably substantially square shape in cross section, which is defined in the first side and extends proximate the bottom. A vertical abutment is formed between a lower-most edge of the opening and the bottom to prevent unassisted dispensing of merchandise.

A support member extends from the upright merchandise display and secures the dispensing device proximate its top to support the device at the desired elevation. The support member may include an elongated extending member, fixed or telescoping, and off-shelf extending bracket, or a clip. The open top of the device further facilitates reloading of quantities of merchandise without having to first dismount the device from the merchandising display.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

Figure 1:
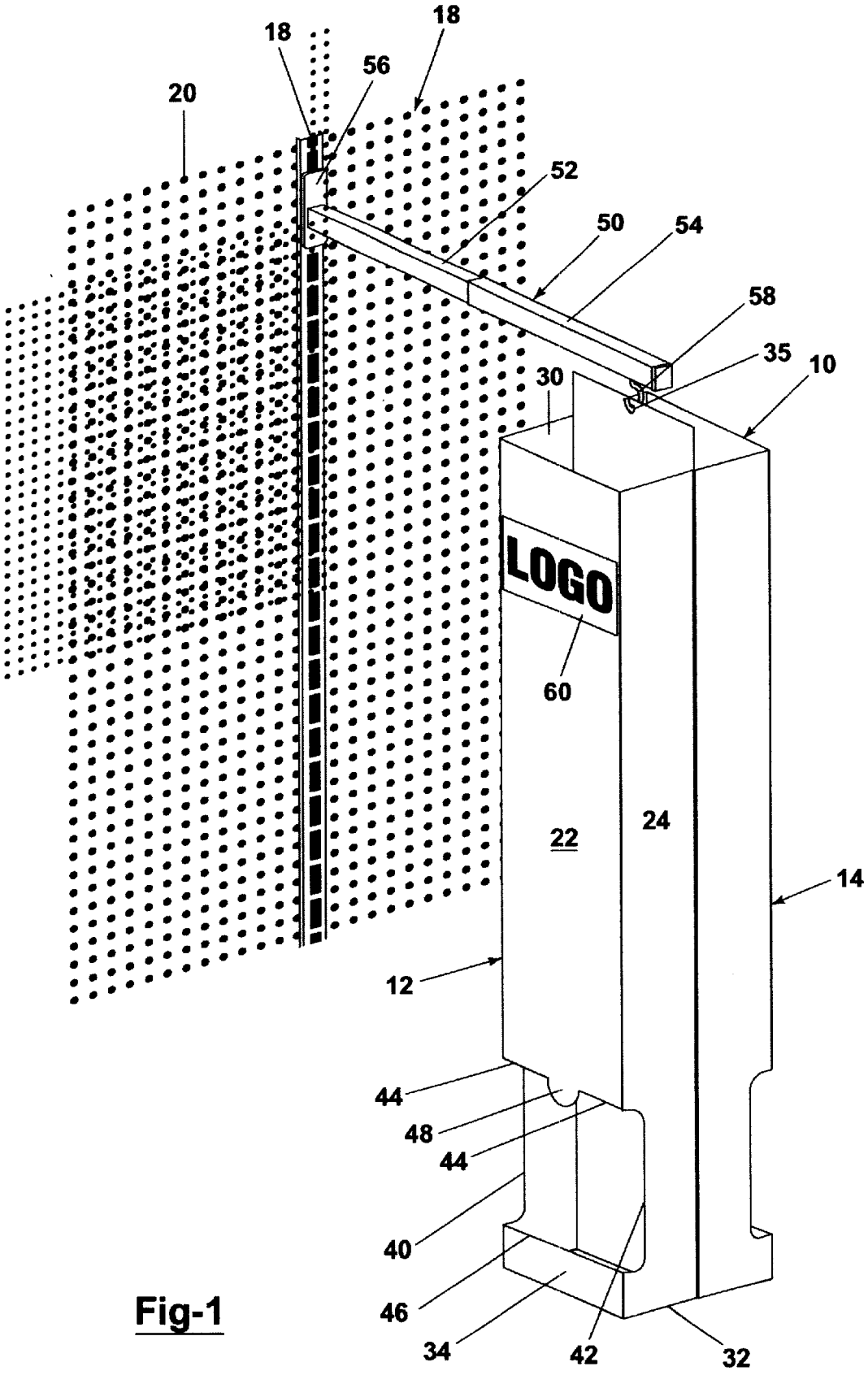
FIG. 1 is a perspective view of the gravity feed merchandise device according to a first preferred embodiment of the present invention and in which first and second identically constructed devices are suspended from a conventional merchandising display and back-to-back secure fashion and by a first selected support member.

Referring now to FIG. 1, a gravity feed device is illustrated at 10 according to a first preferred embodiment of the present invention. The device according to the first embodiment actually illustrates first 12 and second 14 individual and substantially identically constructed devices and which is secured to an upright merchandising display 16. The merchandising display 16 is conventionally known in the art and may include a vertically extending and slotted bracket 18 and/or a multiple apertured pegboard surface 20.

Figure 2:
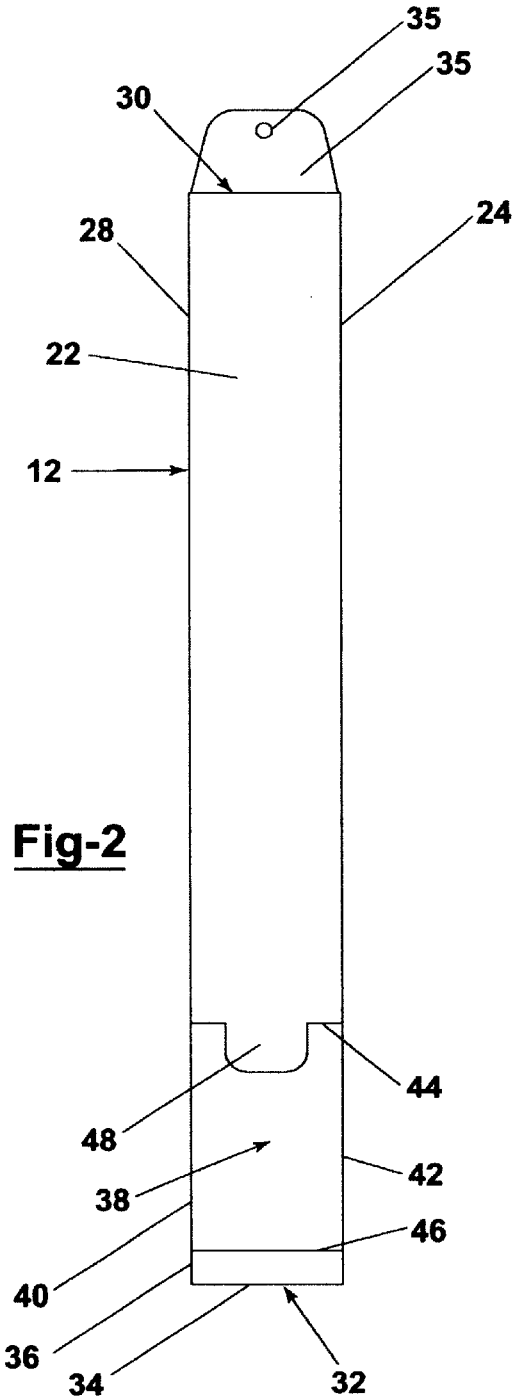
FIG. 2 is a front view of a selected and individual merchandising device according to the present invention.
Figure 3:
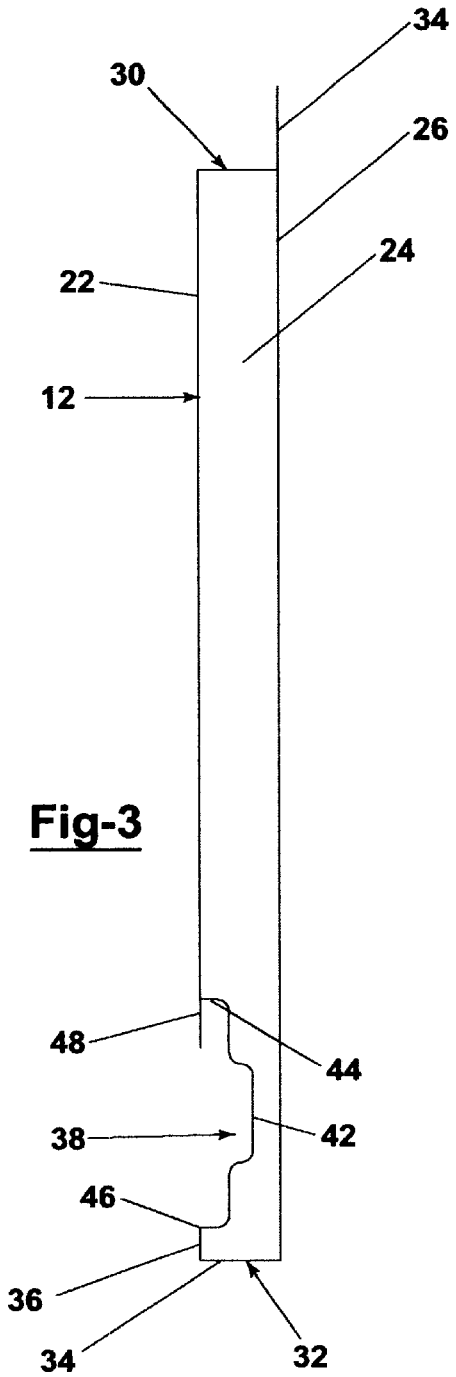
FIG. 3 is a side view of the merchandising device illustrated in FIG. 2.
Figure 4:
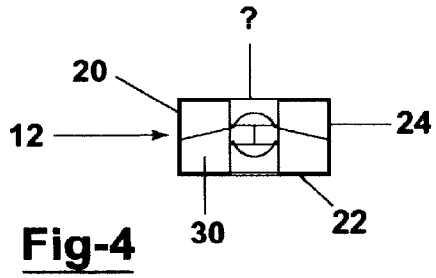
FIG. 4 is a top view of the merchandising device and showing the internally hollowed aspect provided by the open top.

Referring to FIGS. 2, 3 and 4 in combination, respective top, front and side plan views are illustrated of an individual gravity feed and merchandising display device, such as again is illustrated at 12. In one preferred embodiment, the merchandising device 12 is constructed of a plasticized, substantially transparent and internally hollowed and elongated sleeve shape and includes a substantially rectangular configuration in cross section with first 22, second 24, third 26 and fourth 28 interconnected and axially extending sides. The purpose behind the desire for transparency of the device 12 is so that it provides a high degree of product visibility for the quantities of boxes, bottles or loose/bulk product (not shown) which are loaded into the device 12 and located at an ideal point-of-purchase within a retail store setting.

It is contemplated that the device 12 can also be constructed of a durable paperboard or other suitable material and manufactured as a foldable blank. Alternative construction techniques also contemplate the device 12 manufactured in a rigid three-dimensional configuration. It is also envisioned that the cross sectional and three dimensional shape of the elongated sleeve can be defined in any desired polygonal shape with a plurality of sides, such including a range extending from a three sided and substantially triangular configuration to a cross sectional configuration defined by an infinite number of sides, thereby approaching the configuration of a circle.

The display 12 further includes an open top 30 and a bottom 32. The open top 30, defined around its perimeter by the four sides, reveals an internally open volume of the device 12 and is particularly useful for permitting reloading of quantities of the bulk or loose merchandise (again not shown) without having to first dismount the device 12 from its associated merchandising display 16. It is further envisioned that the top 30 can be shipped with product in a sealed or a reclosable condition and without departing from the scope of the instant invention. Referring again to FIGS. 2 and 3, a flap 34 extends from the top 30 of the device and includes an aperture formed therethrough defined by an annular internally facing edge 35. The aperture facilitates suspending of the device 12 from the existing merchandising display 16 and in a manner which will be subsequently described.

The bottom 32 of the device 12 may further include a multiple sided flap (see at 35 and 36) and which, upon assembling the device first produced as a multi-sided blank, defines bottom face 35 and front face 36 (corresponding, to the first side 22). An opening 38 is formed in the first side 22 of the device 12, proximate the bottom 32. The opening 38 is square-shaped in a preferred embodiment and is defined by a first side edge 40, a second spaced apart side edge 42, an upper-most edge 44 and a lower-most edge 46 sharing a common boundary with an upper edge of the front face 36. The front face 36 further defines a vectical abutment preventing unassisted (and undesired) dispensing of quantities of merchandise and due to the abutment restraining a bottom layer of bulk or loose merchandise which in turn restrains the succeeding layers of merchandise for selective dispensing through the opening 38. A downward extension 48 projects from the upper most edge 44 of the opening 38 and within the area of the opening. The dimensions of the extension 48 may also be modified and one purpose for which is to further restrain unassisted dispensing of the quantities of bulk or loose merchandise.

A support member is illustrated generally at 50 according to a first preferred variant for supporting the device in suspended and horizontally spaced fashion from the existing merchandising display 16. The variant illustrated at 10 in FIG. 1 further contemplates the first 12 and second 14 gravity feed devices being secured in back-to-back fashion, such as through the use of adhesives or the like. The support member 50 further includes an elongate extending member having a first telescoping portion 52 and a second telescoping portion 54. The support member 50 is supported at a first end upon the conventional merchandising display 16 and, according to the first embodiment by an upright attachment 56 which engages a selected one or more of the individual slots formed in the upright extending bracket 18.

A suspending hook 58 extends from the second end of said support member and engaging through the aperture 35 formed proximate the tops of the back-to-back secured devices 12 and 14 and so that the display and dispensing device 10 as arranged in FIG. 1 is freely swingably supported in offset fashion from the conventional merchandising unit 16 and can be located at a desired point-of-purchase to provide high product visibility and high percentage of sales. A further advantage of the dispensing device is that it markedly increases product carrying and visibility of additional quantities of merchandise without any required increase in store investment in conventional shelving and merchandising displays.

Also illustrated in FIG. 1 is an identifying indicia 60 which may be placed upon a selected surface of the device 12 to facilitate product advertisement. Additional commercial embodiments of the invention contemplate placing additional types of indicia advertisements in cooperating fashion with the device 12, the existing merchandising display 12 and/or the selected type of support member (such as again is shown at 50).

Figure 5:
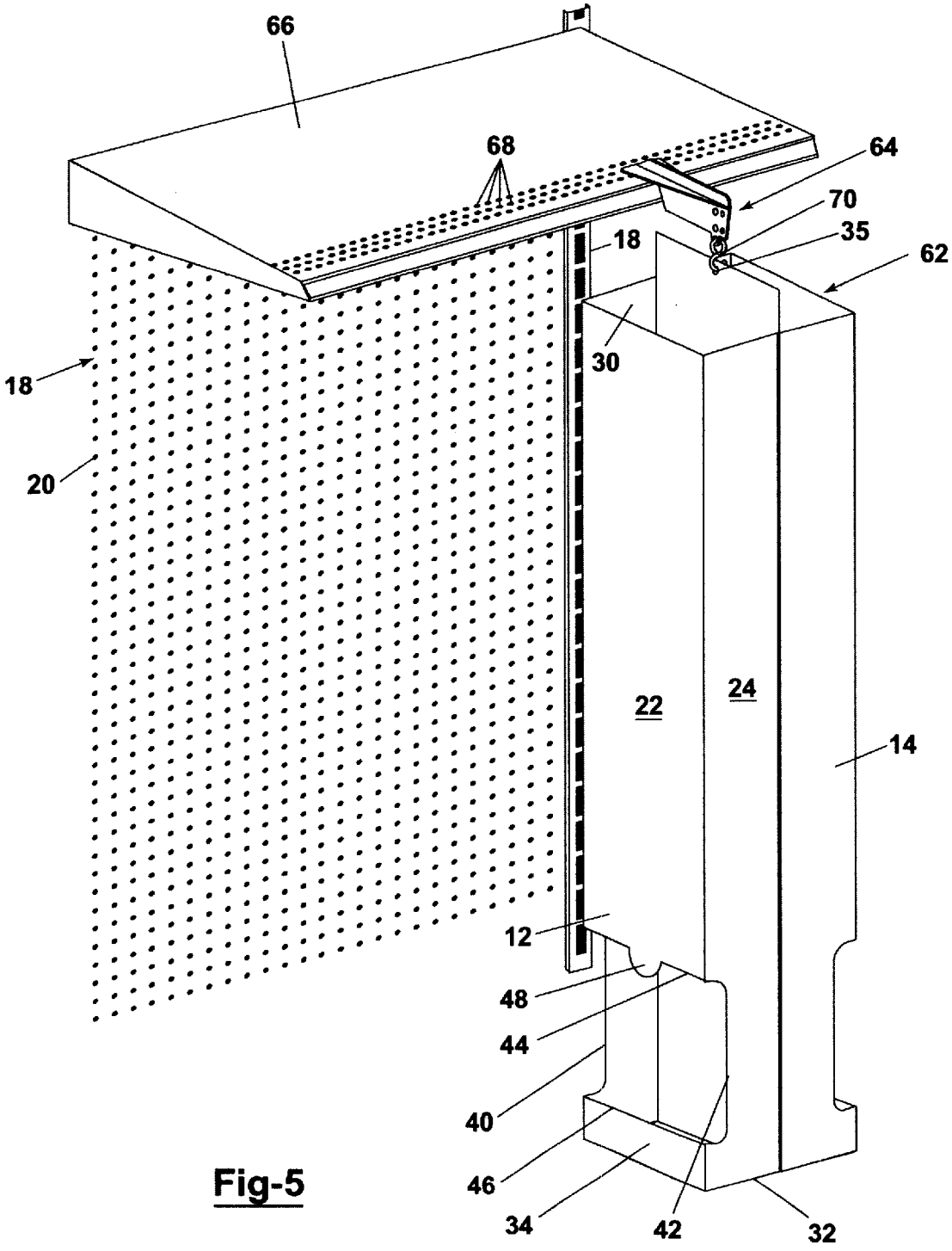
FIG. 5 is a perspective view of the gravity feed merchandise device according to a second preferred embodiment of the present invention and again in which first and second identically constructed devices are suspended from a conventional merchandising display and back-to-back secure fashion and by a second selected support member.

Referring to FIG. 5, a further variation is illustrated at 62 of an alternatively configured support member 64 employed with the gravity feed dispensing device. As with the arrangement shown in FIG. 1, first 12 and second 14 back-to-back secured dispensing devices are illustrated. It is also contemplated that any other style or arrangement of dispensing devices can be employed, such as may include the provision of a single dispensing device 12.

The support member 64 in the arrangement of FIG. 5 further includes a substantially planar shaped and off-shelf extending bracket and which extends from an existing horizontal shelving unit 66 of the merchandising display. A plurality of additional holes or apertures 68 are formed along a front edge 68 of the shelving unit 66 and which secure tabbed portions (not shown) extending from a first end of the off-shelf bracket. A suspending hook 70 extends from a second end of the support member 64 and engages through the aperture formed proximate the top of the back to back attached devices.

Figure 6:
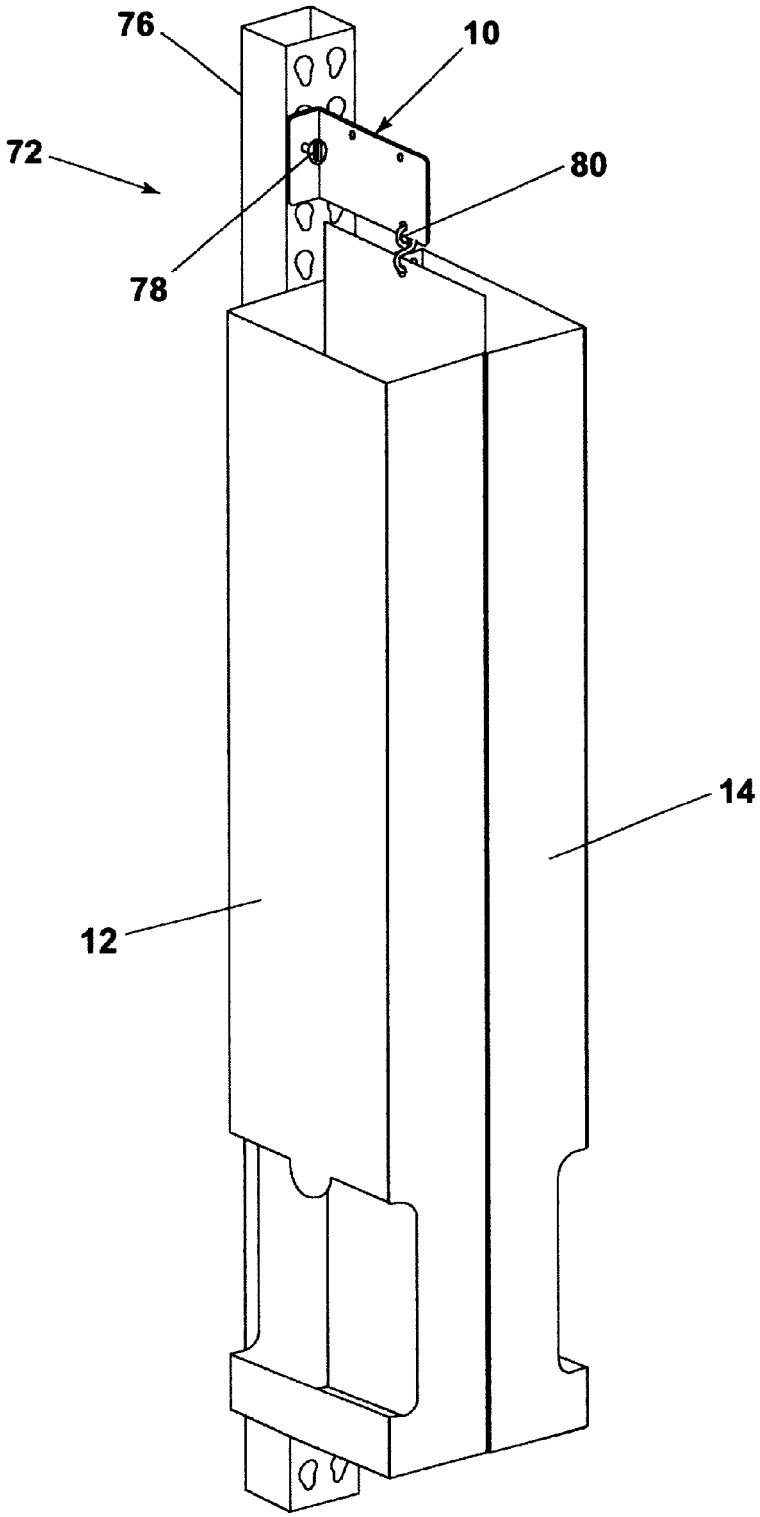
FIG. 6 is a perspective view of the gravity feed merchandise device according to a third preferred embodiment of the present invention and again in which first and second identically constructed devices are suspended from a conventional merchandising display and back-to-back secure fashion and by a third selected support member.

Referring now to FIG. 6, a still further variation is illustrated at 72 of an alternatively configured support member 74 employed with the gravity feed dispensing device. As with the arrangement shown again in the variants of FIGS. 1 and 5, first 12 and second 14 back-to-back secured dispensing devices are illustrated. It is again also contemplated that any other style or arrangement of dispensing devices can be employed, such as may include the provision of a single dispensing device 12 or any other suitable arrangement of one or more devices such as again is illustrated at 12.

The support member 74 in the arrangement of FIG. 6 further includes a further variation of substantially planar shaped and off-shelf extending bracket (such as which may be commercially known as a "Pallet Rack Bracket") and which extends from a further variation 76 of an existing vertical bracket of the merchandising display, the bracket 76 being known as a double-row/double-slotted support bracket. The support bracket 74 includes a mounting fastener 78 at a first end and which secures within a suitable slot in the bracket 76. A suspending hook 80 extends from a second end of the support member 74 and engages through the aperture formed proximate the top of the back to back attached devices to again array the devices in suspended and swingable fashion.

Figure 7:
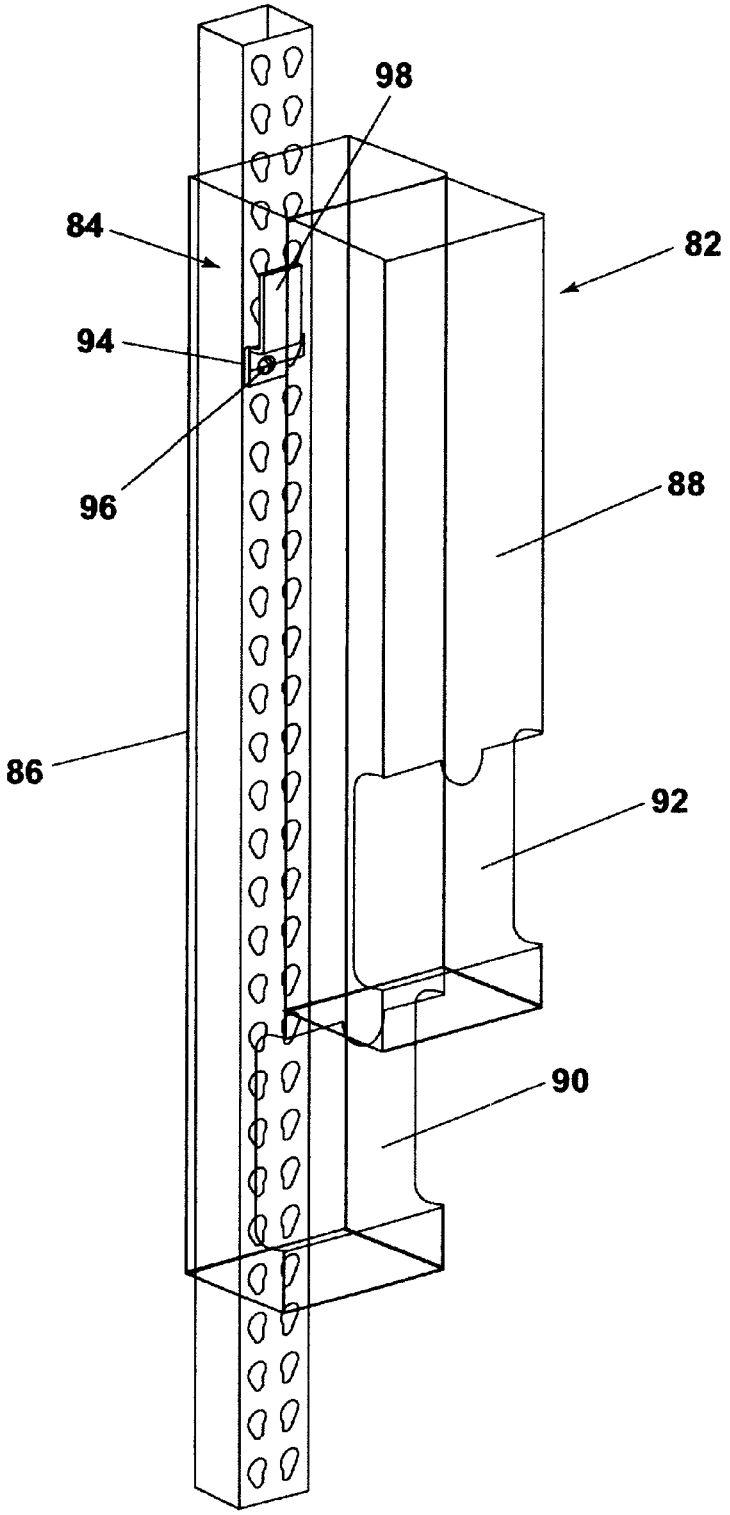
FIG. 7 is a perspective view of the gravity feed merchandise device according to a fourth preferred embodiment of the present invention and again in which first and second identically constructed devices are suspended from a conventional merchandising display and stacked fashion by a fourth selected support member.

Referring finally to FIG. 7, a yet further variation is illustrated, at 82, of an alternatively configured support member 84 employed with the gravity feed dispensing device. The dispensing device arrangement illustrated in FIG. 7 includes first 86 and second 88 dispensing devices arranged in a forwardly stacked arrangement. Each dispensing device 86 and 88 is constructed in substantially identical fashion to that previously disclosed in the embodiments of FIGS. 1–6 and with the exception that the sizing of the second device 88 is sufficiently smaller or shorter than that of the first device 86 so that they can both be stacked in a forwardly facing manner and further so that the association product withdrawal openings (see at 90 and 92) are both unobstructed. The dispensing devices 86 and 88 are further illustrated in phantom to facilitate the showing of their stacked nature and to further assist in an explanation of the features of the support member 84 which will now be undertaken.

The support member 84 in FIG. 7 is constructed as a clip having a first planar surface 94 securing to a vertically extending location of vertically extending support 76 (also shown in FIG. 6) the merchandising display. Particularly, a screw 96 engages within a selected aperture of the support 76. A second stepped and planar surface 98 extends upwardly and seats thereupon a suitable projection (not shown) extending from a rear selected side of the first (or rear) dispensing device 86 to support the first 86 and second 88 stacked devices in a secure manner upon the upright support 76. It is again understood that the fixed or freely swinging nature of securing one or more of the dispensing devices to the existing merchandise displays is left to the discretion of the user and well within the scope of the invention.

Having described my invention, it is apparent that it discloses a gravity feed dispensing device which is capable of being supported upon any conventionally constructed upright merchandising display and in order to provide increased product carrying capability, coupled with high visibility in selected point-of-purchase locations and without any attendant increase in expenditure or capacity of the existing shelving displays. It is also envisioned that the display devices, either singularly or in plurality, can be secured in adhesive "back-to-back" stacked, forwardly stacked or side-by-side arrangement and without departing from the scope of the invention.

Additional preferred embodiments will become apparent to those skilled in the art to which it pertains and without deviating from the scope of the appended claims.

I claim:

1. A gravity feed device for holding and dispensing quantities of bulk merchandise, said device capable of being supported upon an upright merchandising display and comprising:

an elongated and substantially sleeve shape, polygonal in cross section, and having a top, a plurality of first, second, third and fourth interconnecting and elongate extending sides defining a substantially rectangular configuration, and a bottom;

said device being constructed of an assembleable blank and so that a selected elongated extending side of a first device may be secured against a selected elongate extending side of a second and substantially identically constructed device in abutting fashion, said first and second devices being secured in back-to back fashion;

product dispensing means defined in at least one of said plurality of sides and at a specified location proximate said bottom; and support means located proximate said top and from which said device is support at a specified elevated location and upon the merchandising display.

2. The gravity feed device as described in claim 1, said product dispensing means further comprising an opening defined in said first side, a vertical abutment extending between a lower-most edge of said opening and said bottom and acting to prevent unassisted dispensing of quantities of merchandise.

3. The gravity feed device as described in claim 2, said opening further comprising a substantially square shape defined by a first side edge and a second spaced apart side edge which extend between an upper-most edge and said lower-most edge.

4. The gravity feed device as described in claim 3, said upper-most edge further comprising a downward extension projecting within said opening.

5. The gravity feed device as described in claim 1, said device being constructed of an assembleable blank which is substantially transparent.

6. The gravity feed device as described in claim 1, said support means further comprising an extending support member, a first end of said member securing to a selected location along the upright merchandising display, a second end of said member engaging said top of said device.

7. The gravity feed device as described in claim 6, said support member further comprising an elongate extending member, a suspending hook extending from said second end of said support member and engaging through an aperture formed proximate said top of said device.

8. The gravity feed device as described in claim 7, said elongate member further comprising a first telescoping portion and a second telescoping portion.

9. The gravity feed device as described in claim 6, said support member further comprising a substantially planar shaped and off-shelf extending bracket, a suspending hook extending from said second end of said support member and engaging through an aperture formed proximate said top of said device.

10. The gravity feed device as described in claim 6, said support member further comprising a clip having a first planar surface securing to a vertically extending location of the merchandising display, a second stepped and planar surface securing.

11. The gravity feed device as described in claim 6, further comprising an identifying indicia placed upon said display and in proximity to said support member.

12. The gravity feed device as described in claim 1, further comprising an open top to permit reloading of said device.

13. A gravity feed device for holding and dispensing quantities of bulk merchandise, said device capable of being supported upon an upright merchandising display and comprising:

and elongated and substantially sleeve shaped blank having first, second, third and fourth interconnecting and elongate extending sides, a top, and a bottom;

product dispensing means defined in at least one of said plurality of sides and at a specified location proximate said bottom, said dispensing means further comprising an opening defined in said first side, a vertical abutment extending between a lower-most edge of said opening and said bottom, said opening defining a substantially planar and square-shape elevated from said bottom and acting to prevent unassisted dispensing of quantities of merchandise; and support means located proximate said open top and from which said device is supported at a specified elevated location and upon the merchandising display, said support means further comprising an extending support member, a first end of said member securing to a selected location along the upright merchandising display, a second end of said member engaging said top of said device.

14. A gravity feed device for holding and dispensing quantities of merchandise, said device capable of being supported upon an upright merchandising display and comprising:

an elongated and substantially sleeve shape, polygonal in cross section, and having a top, a plurality of elongate extending sides, and a bottom;

product dispensing means defined in at least one of said plurality of sides and at a specified location proximate said bottom; and support means located proximate said top and from which said device is supported at a specified elevated location and upon the merchandising display, said support means further comprising an extending support member, a first end of said member securing to a selected location along the upright merchandising display, a second end of said member engaging said top of said device, said support member further comprising a substantially planar shaped and off-shelf extending bracket, a suspending hook extending from said second end of said support member and engaging through an aperture formed proximate said top of said device.

* * * * *